US008551930B2

(12) United States Patent
Sendor-Muller et al.

(10) Patent No.: US 8,551,930 B2
(45) Date of Patent: Oct. 8, 2013

(54) DISHWASHER DETERGENT

(75) Inventors: Dorota Sendor-Muller, Dusseldorf (DE); Johannes Zipfel, Dusseldorf (DE); Arnd Kessler, Monheim am Rhein (DE); Volker Blank, Leverkusen (DE); Thorsten Bastigkeit, Wuppertal (DE); Christian Nitsch, Dusseldorf (DE); Thomas Eiting, Dusseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/418,658

(22) Filed: Mar. 13, 2012

(65) Prior Publication Data

US 2012/0167923 A1 Jul. 5, 2012

Related U.S. Application Data

(63) Continuation of application No. PCT/EP2010/063176, filed on Sep. 8, 2010.

(30) Foreign Application Priority Data

Sep. 21, 2009 (DE) ..... 10 2009 029 635

(51) Int. Cl.
*C11D 17/00* (2006.01)
*C11D 3/37* (2006.01)

(52) U.S. Cl.
CPC ..... *C11D 3/378* (2013.01)
USPC ..... 510/229; 510/230

(58) Field of Classification Search
USPC ..... 510/229, 230
See application file for complete search history.

(56) References Cited

U.S. PATENT DOCUMENTS

| | | | | |
|---|---|---|---|---|
| 8,268,768 | B2 * | 9/2012 | Sendor-Muller et al. | 510/228 |
| 2004/0127377 | A1 | 7/2004 | Rodrigues | |
| 2006/0116309 | A1 * | 6/2006 | Lambotte et al. | 510/302 |
| 2006/0122089 | A1 * | 6/2006 | Lambotte et al. | 510/295 |
| 2007/0203047 | A1 * | 8/2007 | Pegelow et al. | 510/421 |

FOREIGN PATENT DOCUMENTS

| | | | |
|---|---|---|---|
| DE | 3743739 | A1 | 7/1989 |
| DE | 10050622 | A1 | 5/2002 |
| DE | 10225794 | A1 | 12/2003 |
| DE | 102007006630 | A1 | 8/2008 |
| EP | 0692020 | B1 | 11/1997 |
| EP | 0662117 | B1 | 6/2000 |
| EP | 1113070 | A2 | 7/2001 |
| EP | 0906407 | B1 | 9/2001 |

OTHER PUBLICATIONS

PCT International Search Report (PCT/EP2010/063176) dated Nov. 26, 2010.

* cited by examiner

*Primary Examiner* — Gregory Webb
(74) *Attorney, Agent, or Firm* — David K. Benson

(57) ABSTRACT

The present invention is a phosphate-free automatic dishwashing agent containing a builder, said agent comprising: a) a copolymer A comprising i) at least one mono- or polyunsaturated carboxylic acid monomer, ii) at least one mono- or polyunsaturated sulfonic acid monomer, and iii) at least one additional nonionic monomer; and b) an acrylic acid homopolymer B, wherein the weight ratio of copolymer A to homopolymer B is between 10:1 and 1:3. The present agent is characterized by excellent residue inhibition, good cleaning, and clear rinsing performance in automatic dishwashing.

16 Claims, No Drawings

DISHWASHER DETERGENT

CROSS-REFERENCE TO RELATED APPLICATIONS

This application is a continuation of PCT Application Serial No. PCT/EP2010/063176, filed on Sep. 8, 2010, which claims priority under 35 U.S.C. §119 to 10 2009 029 635.2 (DE) filed on Sep. 21, 2009. The disclosures PCT/EP2010/063176 and DE 10 2009 029 635.2 are hereby incorporated by reference in their entirety.

FIELD OF THE INVENTION

The present invention generally relates to detergents, and more particularly relates to phosphate-free automatic dishwashing detergents comprising a combination of cleaning-active polymers.

BACKGROUND OF THE INVENTION

Higher demands are often made today of machine-washed dishes than of dishes washed manually. After being washed in the dishwasher, a dish should be not only completely free of food residues, for example, but also free of whitish spots caused by water hardness or other mineral salts originating from dried drops of water in the absence of a wetting agent.

Modern automatic dishwashing agents meet these requirements through the integration of cleaning, care, water-softening and clear-rinse active ingredients and are known to the consumer as "2in1" or "3in1" dishwashing agents, for example. The automatic dishwashing agents provided for the private end user contain builders as the essential ingredient for the success of both cleaning and clear rinsing. These builders, first of all, increase the alkalinity of the cleaning liquor, wherein fats and oils are emulsified and saponified with an increase in alkalinity, and also reduce the water hardness of the cleaning liquor due to the chelating of the calcium ions contained in the aqueous liquor. The alkali metal phosphates have proven to be especially effective builders and for this reason form the main ingredient of by far the majority of commercially available automatic dishwashing agents.

Although phosphates are very valuable with regard to their advantageous effect as an ingredient of automatic dishwashing agents, their use is not without problems, however, from the standpoint of environmental protection, because a significant amount of the phosphate enters natural bodies of water via the household wastewater and plays a critical role, especially in standing bodies of water (lakes, ponds) when the latter are overfertilized. As a result of this phenomenon, which is also known as eutrophication, the use of pentasodium triphosphate in textile washing agents has been reduced substantially by law in some countries, e.g., United States, Canada, Italy, Sweden, Norway and/or completely banned in Switzerland. Since 1984, washing agents in Germany are allowed to contain at most 20% of this builder substance.

In addition to nitrilotriacetic acid, mainly sodium aluminosilicates (zeolites) are used as phosphate substitutes or replacements in textile washing agents. However, these substances are not suitable for use in automatic dishwashing agents for various reasons. Therefore, a number of substitutes are discussed in the literature as alternatives to alkali metal phosphates in automatic dishwashing agents, but the citrates are emphasized in particular.

Phosphate-free automatic dishwashing agents, which also contain carbonates, bleaches and enzymes in addition to a citrate, are described in European Patent EP 662 117 B1 (Henkel KGaA) and European Patent EP 692 020 B1 (Henkel KGaA), for example.

Another alternative to the alkali metal phosphates used as the only builder but preferably used in combination with citrates, is methyl glycine diacetic acid (MGDA). Automatic dishwashing agents that contain MGDA are described in European Patent EP 906 407 B1 (Reckitt Benckiser) or in European Patent Application EP 1 113 070 A2 (Reckitt Benckiser), for example.

Despite previous efforts, the manufacturers of automatic dishwashing agents have not so far succeeded in providing phosphate-free automatic dishwashing agents, which are comparable to or even exceed the phosphate-containing cleaning agents with regard to their cleaning and clear-rinse performance and in particular their residue-inhibiting performance. However, such equality in performance is a prerequisite for successful market introduction of cleaning agents that contain phosphate because by far the majority of end consumers will always decide against an ecologically advantageous product, despite broad public discussion, if this product does not meet the market standard with regard to its price and/or performance.

Accordingly, it is desirable to provide a phosphate-free automatic dishwashing agent which is comparable to or even exceeds traditional cleaning agents that contain phosphate with respect to its cleaning performance as well as with respect to its clear-rinse results and its performance with regard to inhibiting deposits. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

It has now been surprisingly found that the formation of deposits in phosphate-free systems can be inhibited through the choice of a polymer system, wherein the resulting phosphate-free automatic dishwashing agents also have a good cleaning and clear-rinse performance in addition to having an above-average deposit-inhibiting effect.

In an exemplary embodiment of the present invention, a phosphate-free automatic dishwashing agent comprises: a) a copolymer A comprising (i) at least one mono- or polyunsaturated carboxylic acid monomer, (ii) at least one mono- or polyunsaturated sulfonic acid monomer, and (iii) at least one additional nonionic monomer; and b) an acrylic acid homopolymer B, wherein the weight ratio of copolymer A to homopolymer B is between 10:1 and 1:3.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

With that being said, it has surprisingly been found that the deposit-forming properties of phosphate-free automatic dishwashing agents can be improved by combining hydrophobically modified polysulfonic acid (copolymer A) with acrylic acid homopolymer (acrylic acid homopolymer B) in certain quantity ratios. With respect to inhibiting deposits, it has been found to be especially advantageous if the weight ratio of copolymer A to homopolymer B is between 9:1 and 1:2, preferably between 8:1 and 1:1 and in particular between 5:1 and 2:1.

The polysulfonates used according to the invention also contain at least one monomer from the group of unsaturated sulfonic acids and at least one unsaturated nonionic monomer, in addition to a monomer from the group of unsaturated carboxylic acids.

Especially preferred unsaturated carboxylic acid(s) is/are unsaturated carboxylic acids of the formula $R^1(R^2)C{=}C(R^3)COOH$, in which $R^1$ to $R^3$ independently of one another stand for —H, —$CH_3$, a linear or branched, saturated alkyl residue with 2 to 12 carbon atoms, a linear or branched mono- or polyunsaturated alkenyl residue with 2 to 12 carbon atoms, alkyl or alkenyl residues substituted with —$NH_2$, —OH or —COOH as defined above, or for —COOH or —$COOR^4$, wherein $R^4$ is a saturated or unsaturated, linear or branched hydrocarbon residue with 1 to 12 carbon atoms.

Especially preferred unsaturated carboxylic acids include acrylic acid, methacrylic acid, ethacrylic acid, α-chloroacrylic acid, α-cyanoacrylic acid, crotonic acid, α-phenylacrylic acid, maleic acid, maleic anhydride, fumaric acid, itaconic acid, citraconic acid, methylene malonic acid, sorbic acid, cinnamic acid or mixtures thereof. Unsaturated dicarboxylic acids may of course also be used.

Of the unsaturated sulfonic acids, those of the formula $R^5(R^6)C{=}C(R^7)—X—SO_3H$ are preferred, wherein $R^5$ to $R^7$ independently of one another stand for —H, —$CH_3$, a linear or branched, saturated alkyl residue with 2 to 12 carbon atoms, a linear or branched mono- or polyunsaturated alkenyl residue with 2 to 12 carbon atoms, alkyl or alkenyl residues substituted with —$NH_2$, —OH or —COOH, or for —COOH or —$COOR^4$, wherein $R^4$ is a saturated or unsaturated, linear or branched hydrocarbon residue with 1 to 12 carbon atoms, and X is an optional spacer group, selected from —$(CH_2)_n$, wherein n=0 to 4, —COO—$(CH_2)_k$, wherein k=1 to 6, —C(O)—NH—$C(CH_3)_2$—, —C(O)—NH—$C(CH_3)_2$—$CH_2$— and —C(O)—NH—$CH(CH_2CH_3)$—.

The preferred monomers are selected from the group consisting of:

$H_2C{=}CH—X—SO_3H$, $H_2C{=}C(CH_3)—X{=}SO_3H$, $HO_3S—X—(R^6)C{=}C(R^7)—X—SO_3H$, and mixtures thereof, wherein $R^6$ and $R^7$ independently of one another are selected from —H, —$CH_3$, —$CH_2CH_3$, —$CH_2CH_2CH_3$, —$CH(CH_3)_2$ and X stands for a spacer group, which is optionally present and is selected from $(CH_2)_n$ where n=0 to 4, —COO—$(CH_2)_k$ where k=1 to 6, —C(O)—NH—$C(CH_3)_2$—, —C(O)—NH—$C(CH_3)_2$— and —C(O)—NH—$CH(CH_2CH_3)$—.

Especially preferred monomers that contain sulfonic acid groups include 1-acrylamido-1-propanesulfonic acid, 2-acrylamido-2-propanesulfonic acid, 2-acrylamino-2-methyl-1-propanesulfonic acid, 2-methacrylamido-2-methyl-1-propanesulfonic acid, 3-methacrylamido-2-hydroxypropane sulfonic acid, allylsulfonic acid, methallylsulfonic acid, allyloxybenzene sulfonic acid, methallyloxybenzene sulfonic acid, 2-hydroxy-3-(2-propenyloxy)propane sulfonic acid, 2-methyl-2-propene-1-sulfonic acid, styrene sulfonic acid, vinyl sulfonic acid, 3-sulfopropyl acrylate, 3-sulfopropyl methacrylate, sulfomethacrylamide, sulfomethyl methacrylamide, the water-soluble salts of each of the above, and mixtures thereof.

The sulfonic acid groups in the polymers may be present partially or entirely in neutralized form, i.e., the acidic hydrogen atom of the sulfonic acid group in some or all of the sulfonic acid groups may be replaced by metal ions, preferably alkali metal ions, and in particular sodium ions. The use of partially or fully neutralized copolymers containing sulfonic acid groups is preferred according to the invention.

The molecular weight of the sulfo copolymers A that are preferred for use according to the invention may be varied to adapt the properties of the polymers to the desired intended purpose. Preferred automatic dishwashing agents are characterized in that the copolymers A have a molecular weight of more than 10,000, preferably between 10,000 and 80,000 and in particular between 20,000 and 50,000.

The polymer sulfonates also encompass, in addition to carboxyl groups and sulfonic acid groups containing monomers, at least one nonionic hydrophobic monomer. By using this hydrophobically modified polymer, the clear-rinse performance in particular of the automatic dishwashing agents according to the invention can be improved.

The nonionic monomers are preferably monomers of the general formula $R^1(R^2)C{=}C(R^3)—X—R^4$, wherein $R^1$ to $R^3$ independently of one another stand for —H, —$CH_3$ or —$C_2H_5$, X stands for a spacer group, which is optionally present and is selected from —$CH_2$—, —C(O)O— and —C(O)—NH—, and $R^4$ stands for a linear or branched, saturated alkyl radical with 2 to 22 carbon atoms or for an unsaturated, preferably aromatic radical with 6 to 22 carbon atoms.

Especially preferred nonionic monomers are butene, isobutene, pentene, 3-methylbutene, 2-methylbutene, cyclopentene, hexane, 1-hexane, 2-methyl-1-pentene, 3-methyl-1-pentene, cyclohexene, methyl cyclopentene, cycloheptene, methyl cyclohexene, 2,4,4-trimethyl-1-pentene, 2,4,4-trimethyl2-pentene, 2,3-dimethyl-1-hexene, 2,4-dimethyl-1-hexene, 2,5-dimethyl-1 hexene, 3,5-dimethyl-1-hexene, 5,4-dimethyl-1-hexane, ethyl cyclohexyne, 1-octene, α-olefins with 10 or more carbon atoms such as 1-decene, 1-dodecene, 1-hexadecene, 1-octadecene and $C_{22}$-α-olefin, 2-styrene, α-methylstyrene, 3-methylstyrene, 4-propylstyrene, 4-cyclohexylstyrene, 4-dodecylstyrene, 2-ethyl-4-benzylstyrene, 1-vinylnaphthalene, 2-vinylnaphthalene, acrylic acid methyl ester, acrylic acid ethyl ester, acrylic acid propyl ester, acrylic acid butyl ester, acrylic acid pentyl ester, acrylic acid hexyl ester, methacrylic acid methyl ester, N-(methyl)acrylamide, acrylic acid 2-ethylhexyl ester, methacrylic acid 2-ethylhexyl ester, N-(2-ethylhexyl)acrylamide, acrylic acid octyl ester, methacrylic acid octyl ester, N-(octyl)acrylamide, acrylic acid lauryl ester, methacrylic acid lauryl ester, N-(lauryl) acrylamide, acrylic acid stearyl ester, methacrylic acid stearyl ester, N-(stearyl)acrylamide, acrylic acid behenyl ester, methacrylic acid behenyl ester and N-(behenyl)acrylamide or mixtures thereof.

The amount by weight of copolymer A, based on the total weight of the automatic dishwashing agent, is preferably between 2 and 20 wt %, preferably between 4 and 16 wt %, and in particular between 6% and 12 wt %.

The second ingredient of the polymer combination according to the invention is a homopolymer of acrylic acid. Homopolymers of acrylic acid with a molecular weight below 15,000, preferably between 500 and 12,000, and in particular between 1200 and 5000.

The amount by weight of acrylic acid homopolymer B in the total weight of the automatic dishwashing agent is preferably between 0.2 and 10.0 wt %, preferably between 0.4 and 8.0 wt %, and in particular between 1.0% and 5.0 wt %.

TABLE 1 shows a few examples of recipes of preferred phosphate-free automatic dishwashing agents according to the invention.

TABLE 1

| Phosphate-free automatic dishwashing agents | | | | |
|---|---|---|---|---|
| Ingredients (wt. %) | Recipe 1 | Recipe 2 | Recipe 3 | Recipe 4 |
| Sulfo-Copolymer A (MW 10,000-80,000) | 2.0 to 20 | 4.0 to 16 | 6.0 to 12 | 6.0 to 12 |
| Acrylic acid homopolymer B (MW 500-12,000) | 0.2 to 10 | 0.4 to 8.0 | 1.0 to 5.0 | 1.0 to 5.0 |
| Misc. | Add 100 | Add 100 | Add 100 | Add 100 |

The automatic dishwashing agents according to the invention preferably contain additional builders but do not contain any phosphate.

A first group of builders that may be used are the inorganic builders, in particular the carbonates and silicates.

The use of carbonate(s) and/or bicarbonate(s), preferably alkali carbonate(s), is especially preferred, and sodium carbonate is especially preferred. Automatic dishwashing agents, characterized in that the automatic dishwashing agent contains carbonate, wherein the amount by weight of the carbonate relative to the total weight of the automatic dishwashing agent is preferably between 5 and 50 wt %, preferably between 10 and 45 wt %, and in particular between 15 and 40 wt %, are preferred according to the invention.

TABLE 2 below shows a few examples of recipes for preferred phosphate-free automatic dishwashing agents according to the invention.

TABLE 2

| Preferred phosphate-free automatic dishwashing agents | | | | |
|---|---|---|---|---|
| Ingredients (wt. %) | Recipe 1 | Recipe 2 | Recipe 3 | Recipe 4 |
| Carbonate | 5.0 to 50 | 10 to 45 | 10 to 45 | 20 to 40 |
| Sulfo-Copolymer A (MW 10,000-80,000) | 2.0 to 20 | 4.0 to 16 | 6.0 to 12 | 6.0 to 12 |
| Acrylic acid homopolymer B (MW 500-12,000) | 0.2 to 10 | 0.4 to 8.0 | 1.0 to 5.0 | 1.0 to 5.0 |
| Misc. | Add 100 | Add 100 | Add 100 | Add 100 |

The group of silicates preferred for use includes crystalline sheet silicates such as amorphous silicates. However, automatic dishwashing agents according to the invention preferably do not contain any zeolites.

Crystalline sheet silicates of the general formula $NaMSi_xO_{2x+1}.yH_2O$, wherein M denotes sodium or hydrogen, x is a number from 1.9 to 22, preferably from 1.9 to 4, wherein preferred values for x are 2, 3 or 4, and y stands for a number from 0 to 33, preferably from 0 to 20, are preferred for use. The cleaning agents according to the invention preferably contain the crystalline sheet silicate of the formula $NaMSi_xO_{2x+1-}.yH_2O$ in an amount by weight of 0.1 to 20 wt %, preferably 0.2 to 15 wt %, and in particular 0.4 to 10 wt %, each based on the total weight of these agents. With respect to the formation of deposits it has proven advantageous to limit the amount by weight of the silicate in the total weight of the automatic dishwashing agent. Preferred automatic dishwashing agents therefore contain less than 8.0 wt % silicate, especially preferably less than 6.0 wt % silicate, and in particular less than 4.0 wt % silicate, i.e., between 0.1 and 4.0 wt % silicate, for example.

Amorphous sodium silicates with a $Na_2O:SiO_2$ modulus of 1:2 to 1:3.3, preferably from 1:2 to 1:2.8, and in particular from 1:2 to 1:2.6, may also be used.

TABLE 3 below gives a few examples of recipes for preferred phosphate-free automatic dishwashing agents according to the invention.

TABLE 3

| Preferred phosphate-free automatic dishwashing agents | | | | |
|---|---|---|---|---|
| Ingredients (wt. %) | Recipe 1 | Recipe 2 | Recipe 3 | Recipe 4 |
| Silicate | 0.1 to 20 | 0.2 to 15 | 0.4 to 10 | 0.4 to 10 |
| Sulfo-Copolymer A (MW 10,000-80,000) | 2.0 to 20 | 4.0 to 16 | 6.0 to 12 | 6.0 to 12 |
| Acrylic acid homopolymer B (MW 500-12,000) | 0.2 to 10 | 0.4 to 8.0 | 1.0 to 5.0 | 1.0 to 5.0 |
| Misc. | Add 100 | Add 100 | Add 100 | Add 100 |

Organic cobuilders include in particular polycarboxylates/polycarboxylic acids such as citrate, ethylenediamine-N,N'-disuccinate (EDDS) and phosphonates.

Automatic dishwashing agents, characterized in that the automatic dishwashing agent contains at least one builder from the group of organic complexing agents, preferably at least one organic chelating agent from the group of citrate, ethylenediamine-N,N'-disuccinate (EDDS) and phosphonate are preferred according to the invention.

Citrate is an especially preferred ingredient of the agents according to the invention. The term "citrate" includes both citric acid and its salts, in particular its alkali metal salts. Especially preferred automatic dishwashing agents according to the invention contain citrate, preferably sodium citrate in amounts of 12 to 50 wt %, preferably 15 to 40 wt %, and in particular 15 to 30 wt %, each based on the total weight of the automatic dishwashing agent.

TABLE 4 below shows a few examples of recipes for preferred phosphate-free automatic dishwashing agents according to the invention.

TABLE 4

| Preferred phosphate-free automatic dishwashing agents | | | | |
|---|---|---|---|---|
| Ingredients (wt. %) | Recipe 1 | Recipe 2 | Recipe 3 | Recipe 4 |
| Citrate | 12 to 50 | 12 to 50 | 15 to 40 | 15 to 30 |
| Carbonate | 5.0 to 50 | 10 to 45 | 10 to 45 | 20 to 40 |
| Sulfo-Copolymer A (MW 10,000-80,000) | 2.0 to 20 | 4.0 to 16 | 6.0 to 12 | 6.0 to 12 |
| Acrylic acid homopolymer B (MW 500-12,000) | 0.2 to 10 | 0.4 to 8.0 | 1.0 to 5.0 | 1.0 to 5.0 |
| Misc. | Add 100 | Add 100 | Add 100 | Add 100 |

Other usable organic builder substances include, for example, the polycarboxylic acids that may be used in the form of the free acid and/or their sodium salts, wherein polycarboxylic acids are understood to be carboxylic acids having more than one acid function. For example, these may include adipic acid, succinic acid, glutaric acid, malic acid, tartaric acid, maleic acid, fumaric acid, sugar acids, aminocarboxylic acids, nitrilotriacetic acid (NTA), if such a use is not objectionable for ecological reasons, as well as mixtures thereof. The free acids typically also have the property of an acidifying component in addition to their builder effect, and therefore they are also used to adjust a lower and milder pH of washing agents or cleaning agents. In particular succinic acid, glutaric acid, adipic acid, glucuronic acid and any mixtures thereof may be mentioned here.

The chelating phosphonates encompass, in addition to 1-hydroxyethane-1,1-diphosphonic acid, a number of different compounds, for example, diethylenetriamine penta(methylenephosphonic acid) (DTPMP). In this patent application in particular, hydroxyalkane and/or aminoalkane phosphonates are preferred. Of the hydroxyalkane phosphonates, 1-hydroxyethane-1,1-diphosphonate (HEDP) is particularly important as a cobuilder. It is preferably used as a sodium salt; the disodium salt gives a neutral reaction, and the tetrasodium salt gives an alkaline reaction (pH 9). Ethylenediamine tetramethylene phosphonate (EDTMP), diethylenetriamine pentamethylene phosphonate (DTPMP) and their higher homolog are preferably considered as the aminoalkane phosphonates. They are preferably used in the form of the neutral sodium salts, e.g., as the hexasodium salt of EDTMP and/or as the hepta- and octasodium salts of DTPMP. Preferably HEDP is used as a builder from the class of phosphonates. The aminoalkane phosphonates also have a pronounced heavy metal binding capacity. Accordingly, it may be preferable to use aminoalkane phosphonates, in particular DTPMP, or mixtures of the aforementioned phosphonates in particular when the agents also contain bleaches.

Automatic dishwashing agents which contain 1-hydroxyethane-1,1-diphosphonic acid (HEDP) or diethylenetriamine penta(methylenephosphonic acid) (DTPMP) as the phosphonates are especially preferred. The automatic dishwashing agents according to the invention may of course contain two or more different phosphonates. The amount by weight of phosphonates relative to the total weight of the automatic dishwashing agents according to the invention is preferably 1 to 8 wt %, preferably 1.2 to 6 wt % and in particular 1.5 to 4 wt %.

The residue properties of the automatic dishwashing agents according to the invention were further improved by the addition of phosphonate.

TABLE 5 below shows a few examples of recipes of preferred phosphate-free automatic dishwashing agents according to the invention.

TABLE 5

Preferred phosphate-free automatic dishwashing agents

| Ingredients (wt. %) | Recipe 1 | Recipe 2 | Recipe 3 | Recipe 4 |
|---|---|---|---|---|
| Phosphonate | 1.0 to 8.0 | 1.2 to 6.0 | 1.2 to 6.0 | 1.5 to 4.0 |
| Sulfo-Copolymer A (MW 10,000-80,000) | 2.0 to 20 | 4.0 to 16 | 6.0 to 12 | 6.0 to 12 |
| Acrylic acid homopolymer B (MW 500-12,000) | 0.2 to 10 | 0.4 to 8.0 | 1.0 to 5.0 | 1.0 to 5.0 |
| Misc. | Add 100 | Add 100 | Add 100 | Add 100 |

Preferred automatic dishwashing agents contain surfactants, preferably nonionic and/or amphoteric surfactants as an additional ingredient.

It has surprisingly been found that the melting points of the nonionic surfactants used in the surfactant system according to the invention affect the formation of deposits in automatic dishwashing. The prerequisite for this technical effect is, among other things, that at least one of the surfactants used has a melting point above 25° C. In particular such automatic dishwashing agents according to the invention in which at least one nonionic surfactant has a melting point above 28° C., preferably above 31° C. are preferred.

The amount by weight of the nonionic surfactant, relative to the total weight of the automatic dishwashing agent, is preferably between 0.5 to 8.0 wt %, preferably between 1.0 and 8.0 wt %, and in particular between 2.0 to 7.0 wt %.

In addition to the aforementioned factors, the residue inhibiting effect of the automatic dishwashing agents according to the invention is also influenced by the structure of the nonionic surfactants used. Especially convincing results are achieved with regard to the inhibition of deposits in particular by end group-capped nonionic surfactants from the group of hydroxy mixed ethers. These nonionic surfactants have proven to be superior to the other known nonionic surfactants from the state of the art.

Another preferred ingredient of the automatic dishwashing agents according to the invention is a nonionic surfactant of the general formula:

$$R^1\text{—}\underset{R^2}{CH(OH)}CH_2O\text{-}(AO)_w\text{-}(A'O)_x\text{-}(A''O)_y\text{-}(A'''O)_z\text{—}$$

wherein $R^1$ and $R^2$ denote a $C_{2-26}$ alkyl residue; A, A', A" and A'" independently denote a residue chosen from the group of —$CH_2CH_2$, —$CH_2CH_2$—$CH_2$, —$CH_2CH(CH_3)$, —$CH_2$—$CH_2$—$CH_2$—$CH_2$, $CH_2$—$CH_2$—$CH_2$—$CH_2$, —$CH_2$—$CH(CH_3)$—$CH_2$—, —$CH_2$—$CH(CH_2$—$CH_3)$; and w, x, y and z denote values between 0.5 and 120, where x, y and/or z may also be 0.

Automatic dishwashing agents according to the invention, in which at least one of the nonionic surfactants has the aforementioned general formula, are preferred because of their better residue forming properties.

In particular those end group-capped polyoxyalkylated nonionic surfactants which also have a linear or branched, saturated or unsaturated, aliphatic or aromatic hydrocarbon residue $R^2$ with 1 to 30 carbon atoms, wherein x stands for values between 1 and 90, preferably for values between 30 and 80, and in particular for values between 30 and 60, according to the formula $R^1O[CH_2CH_2O]_xCH_2CH_2CH(OH)R^2$, in addition to having a residue $R^1$ which stands for linear or branched, saturated or unsaturated, aliphatic or aromatic hydrocarbon residues with 2 to 30 carbon atoms, preferably with 4 to 22 carbon atoms.

Especially preferred are the surfactants of the formula $R^1O[CH_2CH(CH_3)O]_x[CH_2CH_2O]_yCH_2CH(OH)R^2$, wherein $R^1$ stands for a linear or branched aliphatic hydrocarbon residue with 4 to 18 carbon atoms or mixtures thereof, $R^2$ stands for a linear or branched hydrocarbon residue with 2 to 26 carbon atoms or mixtures thereof, and x stands for values between 0.5 and 1.5, and y stands for a value of at least 15. The group of these nonionic surfactants includes, for example, the $C_{2-26}$ fatty alcohol $(PO)_1$-$(EO)_{15-40}$-2-hydroxyalkyl ethers, in particular also the $C_{8-10}$ fatty alcohol $(PO)_1$-$(EO)_{22}$-2-hydroxydecyl ethers.

In addition, such end group-capped polyoxyalkylated nonionic surfactants of the formula $R^1O[CH_2CH_2O]_x[CH_2CH(R^3)O]_yCH_2CH(OH)R^2$, in which $R^1$ and $R^2$ independently of one another stand for a linear or branched, saturated or mono- and/or polyunsaturated hydrocarbon residue with 2 to 26 carbon atoms, $R^3$ independently of one another is selected from —$CH_3$, —$CH_2CH_3$, —$CH_2CH_2$—$CH_3$, —$CH(CH_3)_2$, but preferably stands for —$CH_3$, and x and y, independently of one another, stand for values between 1 and 32, wherein nonionic surfactants in which $R^3$=—$CH_3$ and values for x are between 15 and 32 and y are between 0.5 and 1.5 are most especially preferred.

Additional nonionic surfactants preferred for use here include the end group-capped polyoxyalkylated nonionic surfactants of the formula $R^1O[CH_2CH(R^3)O]_x[CH_2]_kCH(OH)[CH_2]_jOR^2$ in which $R^1$ and $R^2$ stand for linear or branched, saturated or unsaturated aliphatic or aromatic hydrocarbon residues with 1 to 30 carbon atoms, $R^3$ stands for H or a methyl, ethyl, n-propyl, isopropyl, n-butyl, 2-butyl or 2-methyl-2-butyl residue, x stands for values between 1 and 30, k and j stand for values between 1 and 12, preferably between 1 and 5. When the value x is ≥2, then any $R^3$ in the above formula $R^1O[CH_2CH(R^3)O]_x[CH_2]_kCH(OH)[CH_2]_jOR^2$ may be different. $R^1$ and $R^2$ are preferably linear or branched, saturated or unsaturated, aliphatic or aromatic hydrocarbon residues with 6 to 22 carbon atoms, wherein residues with 8 to 18 carbon atoms are especially preferred. For the residue $R^3$, H, —$CH_3$ or —$CH_2CH_3$ is especially preferred. Especially preferred values for x are in the range from 1 to 20, in particular from 6 to 15.

As described above, each $R^3$ in the formula given above may be different, if x≥2. The alkylene oxide unit in the brackets may be varied in this way. For example, if x stands for 3, then the $R^3$ residue may be selected to form ethylene oxide ($R^3$=H) units or propylene oxide ($R^3$=$CH_3$) units, which may be joined to one another in any order, for example (EO)(PO)(EO), (EO)(EO)(PO), (EO)(EO)(EO), (PO)(EO)(PO), (PO)(PO)(EO) and (PO)(PO)(PO). The value 3 for x has been selected as an example and may easily be larger, in which case the range of variation increases with increasing x values and includes, for example, a large number of (EO) groups combined with a small number of (PO) groups or vice versa.

Especially preferred end group-capped polyoxyalkylated alcohols of the formula given above have values of k=1 and j=1, so that the formula given above is simplified to $R^1O[CH_2CH(R^3)O]_xCH_2CH(OH)CH_2OR^2$. In the latter formula, $R^1$, $R^2$ and $R^3$ are defined as above, and x stands for numbers from 1 to 30, preferably from 1 to 20, and in particular from 6 to 18. Surfactants in which the residues $R^1$ and $R^2$ have 9 to 14 carbon atoms, wherein $R^3$ stands for H, and x assumes values of 6 to 15, are especially preferred.

Finally, nonionic surfactants of the general formula $R^1$—$CH(OH)CH_2O$-$(AO)_w$—$R^2$ have proven to be especially effective, wherein $R^1$ stands for a linear or branched, saturated or mono- and/or polyunsaturated $C_{6-24}$ alkyl or alkenyl residue; $R^2$ stands for a linear or branched hydrocarbon residue with 2 to 20 carbon atoms; A stands for a residue from the group $CH_2CH_2$, —$CH_2CH_2$—$CH_2$, —$CH_2$—$CH(CH_3)$; and w stands for values between 10 and 120, preferably between 10 and 80, in particular between 20 and 40.

For example, the $C_{4-22}$ fatty alcohol $(EO)_{10-80}$-2-hydroxyalkyl ethers, in particular also the $C_{8-12}$ fatty alcohol $(EO)_{22}$-2-hydroxydecyl ethers and the $C_{4-22}$ fatty alcohol-$(EO)_{40-80}$-2-hydroxyalkyl ethers belong to this group of nonionic surfactants.

Preferred automatic dishwashing agents according to the invention are free of anionic surfactants.

TABLE 6 shows a few examples of recipes of preferred phosphate-free automatic dishwashing agents according to the invention.

TABLE 6

Preferred phosphate-free automatic dishwashing agents

| Ingredients (wt. %) | Recipe 1 | Recipe 2 | Recipe 3 | Recipe 4 |
|---|---|---|---|---|
| Sulfo-Copolymer A (MW 10,000-80,000) | 2.0 to 20 | 4.0 to 16 | 6.0 to 12 | 6.0 to 12 |
| Acrylic acid homopolymer B (MW 500-12,000) | 0.2 to 10 | 0.4 to 8.0 | 1.0 to 5.0 | 1.0 to 5.0 |
| $C_{4-22}$ fatty alcohol/ $(EO)_{10-80}$-2-hydroxyalkyl ether | 0.5 to 8.0 | 1.0 to 8.0 | 2.0 to 7.0 | 2.0 to 7.0 |
| Misc. | Add 100 | Add 100 | Add 100 | Add 100 |

In addition to the polymers, builders and nonionic surfactants described above, the automatic dishwashing agents according to the invention preferably contain additional washing-active and cleaning-active ingredients, in particular active ingredients from the group of enzymes, bleaching agents, bleach activators and bleach catalysts, corrosion inhibitors, glass corrosion inhibitors, scents or dyes.

Automatic dishwashing agents according to the invention may contain enzyme(s) as an additional ingredient. These include in particular proteases, amylases, lipases, hemicellulases, cellulases, perhydrolases or oxidoreductases as well as preferably the mixtures thereof. These enzymes are of natural origin in principle. Starting from the natural molecules, improved variants are available for use in washing or cleaning agents, and are preferably used accordingly. Washing or cleaning agents preferably contain enzymes in total amounts of $1\times10^{-6}$ to 5 wt %, based on active protein. The protein concentration may be determined with the help of known methods, for example, the BCA method or the biuret method. Especially preferred automatic dishwashing agents also contain enzyme(s), preferably protease and/or amylase, in particular amylase.

Of the proteases, those of the subtilisin type are preferred. Examples include the subtilisins BPN' and Carlsberg as well as their further developed forms, protease PB92, the subtilisins 147 and 309, the alkaline protease from *Bacillus lentus*, subtilisin DY and the enzymes thermitase, proteinase K and proteases TW3 and TW7, which can be assigned to the subtilases but not to the subtilisins in the narrower sense.

Examples of amylases that may be used according to the invention include the α-amylases from *Bacillus licheniformis*, from *B. amyloliquefaciens*, from *B. stearothermophilus*, from *Aspergillus niger* and *A. oryzae* as well as the further developments of the aforementioned amylases, which have been improved for use in washing and cleaning agents. In addition the α-amylase from *Bacillus* sp. A 7-7 (DSM 12368) and the cyclodextrin glucanotransferase (CGTase) from *B. agaradherens* (DSM 9948) are to be emphasized for this purpose.

In addition, lipases or cutinases can also be used according to the invention, in particular because of their triglyceride-cleaving activities but also in order to create peracids in situ from suitable precursors. These include, for example, the lipases that can be obtained originally from *Humicola lanuginose* (*Thermomyces lanuginosus*) and/or further developed lipases, in particular those with the amino acid exchange D96L.

In addition, enzymes which may be combined under the term "hemicellulases" may also be used. These include, for example, mannanases, xanthan lyases, pectin lyases (=pectinases), pectin esterases, pectate lyases, xyloglucanases (=xylanases), pullulanases and β-glucanases.

To increase the bleaching effect, oxidoreductases, for example, oxidases, oxygenases, catalases, peroxidases such as halo-, chloro-, bromo-, lignin, glucose or manganese peroxidases, dioxygenases or laccases (phenol oxidases, polyphenol oxidases) may be used according to the invention to increase the bleaching effect. In addition, preferably organic, especially preferably aromatic compounds which interact with the enzymes are advantageously also added to enhance the activity of the respective oxidoreductases (enhancers) or to ensure the electron flow when there is a greater difference in redox potentials between the oxidizing enzymes and the soiling (mediators).

A preferred automatic dishwashing agent according to the invention is characterized in that the automatic dishwashing agent contains, based on its total weight, enzyme preparation (s) in amounts of 0.1 to 12 wt %, preferably from 0.2 to 10 wt % and in particular from 0.5 to 8 wt %.

A protein and/or enzyme may be protected in particular during storage against damage for example inactivation, denaturing or decomposition, e.g., due to physical influences, oxidation or proteolytic cleavage. Inhibition of proteolysis is especially preferable, in particular when the agents contain proteases and when the proteins and/or enzymes are produced microbially. Washing or cleaning agents may contain stabilizers for this purpose. Providing such agents constitutes a preferred embodiment of the present invention.

Washing or cleaning-active proteases and amylases are not usually supplied in the form of the pure protein but instead are supplied in the form of stabilized preparations suitable for storage and shipping. These prefabricated preparations include, for example, the solid preparations obtained by granulation, extrusion of lyophilization or in particular in the case of liquid or gelatinous agents, solutions of the enzymes, advantageously with the highest possible concentration, a low water content and/or mixed with stabilizers or other auxiliary agents.

As can be seen from the previous discussion, the enzyme protein forms only a fraction of the total weight of the usual enzyme preparations. Protease and amylase preparations preferred for use according to the invention contain between 0.1 and 40 wt %, preferably between 0.2 and 30 wt %, especially preferably between 0.4 and 20 wt % and in particular between 0.8 and 10 wt % of the enzyme protein.

TABLE 7 shows a few examples of recipes for preferred phosphate-free automatic dishwashing agents according to the invention.

TABLE 7

Preferred phosphate-free automatic dishwashing agents

| Ingredients (wt. %) | Recipe 1 | Recipe 2 | Recipe 3 | Recipe 4 |
|---|---|---|---|---|
| Sulfo-Copolymer A (MW 10,000-80,000) | 2.0 to 20 | 4.0 to 16 | 6.0 to 12 | 6.0 to 12 |
| Acrylic acid homopolymer B (MW 500-12,000) | 0.2 to 10 | 0.4 to 8.0 | 1.0 to 5.0 | 1.0 to 5.0 |
| Enzyme preparation | 0.1 to 12 | 0.2 to 10 | 0.2 to 10 | 0.5 to 8.0 |
| Misc. | Add 100 | Add 100 | Add 100 | Add 100 |

Automatic dishwashing agents according to the invention may contain, as an additional ingredient, a bleaching agent, wherein oxygen bleaching agents are preferred. Of the compounds which supply $H_2O_2$ in water and serve as bleaching agents, sodium carbonate, sodium perborate tetrahydrate and sodium perborate monohydrate are especially important. Additional bleaching agents that can be used include, for example, peroxypyrophosphates, citrate perhydrates as well as peracid salts or peracids, which supply $H_2O_2$, such as perbenzoates, peroxophthalates, diperazelaic acid, phthaloimino peracid or diperdodecanedioic acid.

In addition, bleaching agents from the group of organic bleaching agents may also be used. Typical organic bleaching agents include the diacyl peroxides, for example, dibenzoyl peroxide. Other typical organic bleaching agents include the peroxy acids, the alkylperoxy acids and the arylperoxy acids being mentioned in particular as examples.

Preferred automatic dishwashing agents according to the invention are characterized in that they contain an oxygen bleaching agent, preferably sodium percarbonate, especially preferably a coated sodium percarbonate. The amount by weight of the bleaching agent, based on the total weight of the washing or cleaning agent, is between 2.0 and 30 wt %, preferably between 4.0 and 20 wt %, and in particular between 6.0 and 15 wt % in preferred embodiments.

TABLE 8 shows a few examples of recipes of preferred phosphate-free automatic dishwashing agents according to the invention.

TABLE 8

Preferred phosphate-free automatic dishwashing agents

| Ingredients (wt. %) | Recipe 1 | Recipe 2 | Recipe 3 | Recipe 4 |
|---|---|---|---|---|
| Sulfo-Copolymer A (MW 10,000-80,000) | 2.0 to 20 | 4.0 to 16 | 6.0 to 12 | 6.0 to 12 |
| Acrylic acid homopolymer B (MW 500-12,000) | 0.2 to 10 | 0.4 to 8.0 | 1.0 to 5.0 | 1.0 to 5.0 |
| Sodium percarbonate | 2.0 to 30 | 4.0 to 20 | 4.0 to 20 | 4.0 to 20 |
| Misc. | Add 100 | Add 100 | Add 100 | Add 100 |

The automatic dishwashing agents according to the invention may contain bleach activators as the bleach activators. Under perhydrolysis conditions, these compounds yield aliphatic peroxycarboxylic acids, preferably having 1 to 10 carbon atoms, in particular 2 to 4 carbon atoms, and/or optionally substituted perbenzoic acid. Substances having O- and/or N-acyl groups with the aforementioned number of carbon atoms and/or optionally substituted benzoyl groups are suitable. Polyacylated alkylenediamines are preferred, and tetraacetylethylenediamine (TAED) has proven to be especially suitable.

Automatic dishwashing agents, characterized in that they contain as the bleach activator a bleach activator from the group of acetylated amines, preferably tetraacetylenediamine (TAED), are also preferred according to the invention. These bleach activators, in particular TAED, are preferably used in amounts of up to 10 wt %, in particular 0.1 wt % to 10 wt %, especially 0.5 to 8 wt % and especially preferably 1.0 to 6 wt %.

In addition or as an alternative to the conventional bleach activators, the automatic dishwashing agents according to the invention preferably contain at least one bleach activator. These substances include bleach potentiating transition metal salts and/or transition metal complexes such as Mn, Fe, Co, Ru or Mo-salene complexes or Mo-carbonyl complexes. Mn, Fe, Co, Ru, Mo, Ti, V and Cu complexes with tripod ligands containing N as well as Co-, Fe-, Cu- and Ru-ammine complexes may be used as bleach catalysts.

Complexes of manganese in the oxidation stages 11, III, IV or V, preferably containing one or more macrocyclic ligand(s) with the donor functions N, NR, PR, O and/or S are especially preferred. Ligands having nitrogen donor functions are preferred for use. It is especially preferred to use bleach catalyst (s) in the agents according to the invention, in which the catalysts contain as macromolecular ligands 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1,4,7-trimethyl-1,4,7-triazacyclononane (Me/Me-TACN) and/or 2-methyl-1,4,7-triazacyclononane (Me/TACN). Suitable manganese complexes include, for example, $[Mn^{III}{}_2(\mu\text{-}O)_1(\mu\text{-}OAc)_2](ClO_4)_2$, $[Mn^{III}Mn^{IV}\text{-}(\mu\text{-}O)_2(\mu\text{-}OAc)_1(TACN)_2](BPh_4)_2$, $[Mn^{IV}{}_4(\mu\text{-}O)_6(TACN)_4](ClO_4)_4$, $[Mn^{III}{}_2(\mu\text{-}O)_1(\mu\text{-}OAc)_2(Me\text{-}TACN)_2](ClO_4)_2$, $[Mn^{III}Mn^{IV}(\mu\text{-}O)_1(\mu\text{-}OAc)_2(Me\text{-}TACN)_2](ClO_4)_3$, $[Mn^{IV}{}_2(\mu\text{-}O)_3(Me\text{-}TACN)_2](PF_6)_2$ and $[Mn^{IV}{}_2(\mu\text{-}O)_3(Me/Me\text{-}TACN)_2](PF_6)_2(OAc{=}OC(O)CH_3)$.

Automatic dishwashing agents, characterized in that they also contain a bleach catalyst selected from the group of bleach potentiating transition metal salts and transition metal complexes, preferably from the group of complexes of manganese with 1,4,7-trimethyl-1,4,7-triazacyclononane ($Me_3$-TACN) or 1,2,4,7-tetramethyl-1,4,7-triazacyclononane ($Me_4$-TACN), are preferred according to the invention because the cleaning result can be improved significantly by the aforementioned bleach catalyst.

The aforementioned bleach potentiating transition metal complexes, in particular with the central atoms Mn and Co are used in the usual amounts, preferably in an amount of up to 5 wt %, in particular of 0.0025 wt % to 1 wt % and especially preferably from 0.01 wt % to 0.30 wt %, each based on the total weight of the agent containing the bleach catalyst. In special cases, however, more bleach catalyst may also be used.

TABLE 9 shows a few examples of recipes of preferred phosphate-free automatic dishwashing agents according to the invention.

TABLE 9

Preferred phosphate-free automatic dishwashing agents

| Ingredients (wt. %) | Recipe 1 | Recipe 2 | Recipe 3 | Recipe 4 |
|---|---|---|---|---|
| Citrate | 12 to 50 | 12 to 50 | 15 to 40 | 15 to 30 |
| Carbonate | 5.0 to 50 | 10 to 45 | 10 to 45 | 20 to 40 |
| Phosphonate | 1.0 to 8.0 | 1.2 to 6.0 | 1.2 to 6.0 | 1.5 to 4.0 |
| Sulfo-Copolymer A (MW 10,000-80,000) | 2.0 to 20 | 4.0 to 16 | 6.0 to 12 | 6.0 to 12 |
| Acrylic acid homopolymer B (MW 500-12,000) | 0.2 to 10 | 0.4 to 8.0 | 1.0 to 5.0 | 1.0 to 5.0 |
| Sodium percarbonate | 0.5 to 8.0 | 1.0 to 8.0 | 2.0 to 7.0 | 2.0 to 7.0 |
| $C_{4-22}$ fatty alcohol/ $(EO)_{10-80}$-2-hydroxyalkyl ether | 0.1 to 12 | 0.2 to 10 | 0.2 to 10 | 0.5 to 8.0 |
| Sodium percarbonate | 2.0 to 30 | 4.0 to 20 | 4.0 to 20 | 4.0 to 20 |
| Misc. | Add 100 | Add 100 | Add 100 | Add 100 |

The automatic dishwashing agents according to the invention may be present in fabricated forms with which the skilled person is familiar, i.e., in solid or liquid form, for example, but also as a combination of solid and liquid forms.

Suitable solid forms include in particular powders, granules, exudates or compacted forms, in particular tablets. The liquid forms based on water and/or organic solvents may be thickened, in the form of gels.

If they are fabricated in liquid form, preferred automatic dishwashing agents according to the invention contain a water content of preferably 20 to 70 wt %, preferably 30 and 60 wt % and in particular 35 and 55 wt %, based on their total weight.

Agents according to the invention may be fabricated as single phase or as multiphase products. Automatic dishwashing agents having one, two, three or four phases are preferred in particular. Automatic dishwashing agents, characterized in that they are present in the form of a prefabricated dosing unit having two or more phases, are especially preferred.

The individual phases of multiphase agents may have the same or different aggregate states. In particular automatic dishwashing agents containing at least two different solid phases and/or at least two liquid phases and/or at least one solid phase and at least one liquid phase are preferred. In particular two-phase or multiphase tablets for example two-layer tablets, in particular two-layer tablets with a depression and a molded body in the depression are especially preferred.

Automatic dishwashing agents preferred according to the invention are in the form of a tablet, preferably in the form of multilayer tablet.

Automatic dishwashing agents according to the invention are preferably prefabricated to dose units. These dosing units preferably encompass the amount of washing or cleaning-active substance required for one cleaning cycle. Preferred dosing units have a weight between 12 and 30 g, preferably between 14 and 26 g and in particular between 15 and 22 g.

The volume of the aforementioned dosing units and their three-dimensional shape is especially preferably selected so that dosability of the prefabricated units through the dosing chamber of a dishwasher is ensured. The volume of the dosing unit is therefore preferably between 10 and 35 mL, especially between 12 and 30 mL and in particular between 15 and 25 mL.

The automatic dishwashing agents according to the invention, in particular the prefabricated dosing units, especially preferably have a water-soluble coating.

To facilitate the disintegration of prefabricated molded bodies, it is possible to incorporate disintegration aids, so-called tablet disintegrants, into these agents to shorten the disintegration time.

These substances, which are also known as "disintegrants" based on their effect, increase their volume on contact with water, which increases the inherent volume on the one hand (swelling) but also a pressure can be created through the release of gases, causing the tablet to disintegrate into smaller particles. The old familiar disintegration aids include for example carbonate/citric acid systems, but other organic acids may also be use. Swelling disintegration aids include for example synthetic polymers such as polyvinylpyrrolidone (PVP) or natural polymers and/or modified natural substances such as cellulose and starch and their derivatives or alginates or casein derivatives.

Disintegration aids in amounts of 0.5 to 10 wt %, preferably 3 to 7 wt % and in particular 4 to 6 wt %, each based on the total weight of the agent containing the disintegration aid are preferably used.

Disintegration agents based on cellulose are used as the preferred disintegrants, so that preferred washing agents or cleaning agents contain such a disintegrant based on cellulose in amounts of 0.5 to 10 wt %, preferably 3 to 7 wt % and in particular 4 to 6 wt %. The cellulose used as a disintegrant is preferably not used in finally divided form but instead it is converted to a coarser form, for example, being granulated or compacted, before being added to the premixes to be pressed. The particle sizes of such disintegrants are usually greater than 200 μm, preferably at least 90 wt % of the particles being between 300 and 1600 μm, and in particular at least 90 wt % being between 400 and 1200 μm.

Preferred disintegration aids, preferably a disintegration aid based on cellulose, preferably in granular, cogranulated or compacted form, are contained in the agents containing the disintegrant in amounts of 0.5 to 10 wt %, preferably from 3 to 7 wt % and in particular from 4 to 6 wt %, each based on the total weight of the agent containing the disintegrant.

In addition, effervescent systems which release gases may also preferably be used as tablet disintegration aids according to the invention. Preferred effervescent systems, however, consist of at least two ingredients which react with one another to form a gas for example alkali metal carbonate and/or bicarbonate and an acidifying agent suitable for releasing carbon dioxide from the alkali metal salts in aqueous solution. An acidifying agent, which releases carbon dioxide from the aqueous alkali salts, is citric acid, for example.

The active ingredient combinations described above is suitable in particular for cleaning dishes in automatic dishwashing methods. Another subject of the present patent application is a method for cleaning dishes in a dishwashing machine using an automatic dishwashing agent according to the invention, wherein the automatic dishwashing agent is preferably dosed into the interior of a dishwasher during its run through a dishwashing program, before the start of the main rinse cycle or in the course of the main rinse cycle. The dosing, i.e., the addition of the agent according to the invention to the interior of the dishwasher may take place manually, but the agent is preferably dosed into the interior of the dishwasher by means of the dosing chamber of the dishwasher. In the course of the cleaning process, preferably no additional water softener and no additional clear rinse agent are added to the interior of the dishwasher.

The present invention is also a kit for a dishwasher, said kit comprising: (a) an automatic dishwashing agent according to the present invention; and (b) instructions instructing the user to use the automatic dishwashing agent without adding a clear rinse agent and/or a water softener salt is another subject matter of this patent application.

The automatic dishwashing agents according to the invention exhibit their advantageous cleaning and drying properties in particular also in low temperature cleaning methods. Preferred dishwashing methods using the agents according to the invention are therefore characterized in that the dishwasher methods are performed at a bath temperature below 60° C., preferably below 50° C.

As described initially, the agents according to the invention are characterized in comparison with traditional automatic dishwashing agents by a reduced formation of deposits. The use of an automatic dishwashing agent according to the invention to prevent the formation of deposits on glass surfaces in automatic dishwashing is another subject of the present patent application.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

We claim:

1. A phosphate-free automatic dishwashing agent comprising:

a. a copolymer comprising (i) at least one mono- or polyunsaturated carboxylic acid monomer; (ii) at least one mono- or polyunsaturated sulfonic acid monomer; and (iii) at least one additional nonionic monomer;

b. an acrylic acid homopolymer; and c. at least one builder, wherein the weight ratio of copolymer to homopolymer is between 10:1 and 1:3.

2. The agent of claim 1, wherein said builder comprises an organic complexing agent selected from the group consisting of citrate, ethylene diamine N,N'-disuccinate, phosphonate, and mixtures thereof.

3. The agent of claim 1, wherein said copolymer has a molecular weight between 10,000 and 80,000.

4. The agent of claim 1, wherein said homopolymer has a molecular weight between 500 and 12,000.

5. The agent of claim 1, wherein said copolymer is present at from about 2 to about 20 wt. %, based on the total weight of the agent.

6. The agent of claim 5, wherein said copolymer is present at from about 6 to about 12 wt. %, based on the total weight of the agent.

7. The agent of claim 1, wherein said homopolymer is present at from about 0.2 to about 10.0 wt. %, based on the total weight of the agent.

8. The agent of claim 7, wherein said homopolymer is present at from about 1.0 to about 5.0 wt. %, based on the total weight of the agent.

9. The agent of claim 1, further comprising a carbonate at from about 5 to about 50 wt. %, based on the total weight of the agent.

10. The agent of claim 9, wherein said carbonate is present at from about 20 to about 40 wt. %, based on the total weight of the agent.

11. The agent of claim 1 further comprising at least one nonionic surfactant having general formula, $R^1$—CH(OH) $CH_2O$-$(AO)_w$-$(A'O)_x$-$(A''O)_y$-$(A'''O)_z$—$R^2$, wherein $R^1$ and $R^2$ denote a $C_{2-26}$ alkyl residue; A, A', A'' and A''' independently denote a residue chosen from the group of —$CH_2CH_2$, —$CH_2CH_2$—$CH_2$, —$CH_2CH(CH_3)$, —$CH_2$—$CH_2$—$CH_2$—$CH_2$, $CH_2$—$CH_2$—$CH_2$—$CH_2$, —$CH_2$—$CH(CH_3)$—$CH_2$—, —$CH_2$—$CH(CH_2$—$CH_3)$; and w, x, y and z denote values between 0.5 and 120, where x, y and/or z may also be 0.

12. The agent of claim 1 further comprising an enzyme.

13. The agent of claim 12, wherein said enzyme comprises amylase.

14. A phosphate-free automatic dishwashing tablet comprising:

a. a copolymer comprising (i) at least one mono- or polyunsaturated carboxylic acid monomer; (ii) at least one mono- or polyunsaturated sulfonic acid monomer; and (iii) at least one additional nonionic monomer;

b. an acrylic acid homopolymer; and c. at least one builder, wherein the weight ratio of copolymer to homopolymer is between 10:1 and 1:3.

15. A method for the cleaning of dishes in an automatic dishwasher, said method comprising the steps of:

a. placing said dishes in an automatic dishwasher equipped with a dishwashing program that includes a rinse cycle; and b. dosing the tablet of claim 14 into the interior of said dishwasher during its run through said dishwashing program, before the start of the main rinse cycle or in the course of the main rinse cycle, c. wherein no additional water softener and no additional clear rinse agent are added to the interior of the dishwasher in the course of the cleaning.

16. The method of claim 15, wherein said tablet is multilayered.

* * * * *